US007837046B2

(12) United States Patent
Brewster

(10) Patent No.: US 7,837,046 B2
(45) Date of Patent: Nov. 23, 2010

(54) COUPLER CARRIER WITH IMPROVED LUG STRUCTURE FOR RAILROAD CARS

(75) Inventor: John B. Brewster, Homewood, IL (US)

(73) Assignee: Holland, L.P., Crete, IL (US)

( * ) Notice: Subject to any disclaimer, the term of this patent is extended or adjusted under 35 U.S.C. 154(b) by 33 days.

(21) Appl. No.: 11/521,641

(22) Filed: Sep. 15, 2006

(65) Prior Publication Data

US 2008/0067140 A1 Mar. 20, 2008

(51) Int. Cl.
*B61G 7/10* (2006.01)

(52) U.S. Cl. ..... 213/61

(58) Field of Classification Search ..... 213/7, 213/9, 50, 60, 61, 62 R, 75 R
See application file for complete search history.

(56) References Cited

U.S. PATENT DOCUMENTS 4,105,128 A * 8/1978 Spencer ..... 213/61
4,344,541 A * 8/1982 Chierici ..... 213/61
4,376,488 A * 3/1983 Altherr ..... 213/61
4,445,617 A * 5/1984 Elliott ..... 213/60
4,445,618 A 5/1984 Kulieke, Jr.
4,674,639 A * 6/1987 Kaim ..... 213/61
4,706,826 A 11/1987 Elliott et al.

OTHER PUBLICATIONS 3-21 Flyer Edition of Zeftuf Flexible Coupler Carrieres for "F" Type Draft Sills published by Zeftec incorporated, Montgomery, IL.
HOL970057-IM-498 Flyer Edition of Hollube Product SPecification for Model: WE-4004 Coupler Carrier for Rotary Dump Coal Cars published by Holland Company, Crete, IL.
1984 Edition of Car and Locomotive Cyclopedia published by Simmons-Boardman Publishing Corporation, p. 316.

* cited by examiner

*Primary Examiner*—S. Joseph Morano
*Assistant Examiner*—Robert J McCarry, Jr.
(74) *Attorney, Agent, or Firm*—Meroni & Meroni, P.C.; Charles F. Meroni, Jr.; Christopher J. Scott

(57) ABSTRACT

A self-lubricating, non-metallic type F coupler carrier improves upon state of the art railroad car coupler carrier arrangements. The coupler carrier is mounted within a cage, which coupler carrier comprises certain structures formed from an ultra high molecular weight polymer. The coupler carrier is shaped to define a load support surface for supporting a coupler shank. Further, oppositely facing forward and back carrier walls define vertically disposed slide surfaces formed for close fitted engagement with the inner and outer walls of the striker cage. Lugs, integrally formed with the coupler carrier comprise outwardly and upwardly facing slide surfaces for close fitted engagement with cage side walls and retainer plates, respectively. The lugs may further comprise concave relief portions intermediate the lug slide surfaces and the walls to which the lugs are integrally formed to provide stress concentration relief to said type F non-metallic coupler carrier.

22 Claims, 7 Drawing Sheets

COUPLER CARRIER WITH IMPROVED LUG STRUCTURE FOR RAILROAD CARS

BACKGROUND OF THE INVENTION

1. Field of the Invention

This invention generally relates to a non-metallic coupler carrier used in a coupler carrier arrangement for railroad cars, and more particularly, to the spring or resiliently supported type coupler carrier for type F couplers that are commonly associated with the familiar open centered striker castings through which the coupler shank extends for anchoring to the car sill. This invention is essentially an improved configuration of a non-metallic railroad coupler carrier and wear plate having improved geometry enhancing both operational characteristics including increased loss prevention.

2. Description of Related Art

Type F coupler carriers were originally constructed from metal materials and included within a coupler carrier arrangement that is commonly employed in Association of American Railroads (AAR) standard F type interlocking coupler applications, an illustration of which is shown at page 316 of the 1984 Edition of Car and Locomotive Cyclopedia published by Simmons-Boardman Publishing Corporation. Resiliently supported coupler carrier arrangements of this type are commonly employed in cars designed for use in the so-called unit trains. This arrangement is further described within the following references. The disclosures in these patents is incorporated by reference in the instant application as if fully set forth herein.

U.S. Pat. No. 4,105,128 ('128 patent), which issued to Spencer, discloses a Wear Surface Arrangement for Coupler Carrier Assemblies. The '128 patent teaches a coupler carrier assembly for an F type railroad car coupler utilizing a housing having large area wear plates located and secured by spaced lugs on the front and back walls of the housing. A pair of holes in each of the walls coincident with the plates is provided to facilitate welding of the plates to the walls and the housing back wall is straight to enable the use of a single large area flat wear plate on the back wall, which is interchangeably useable on the front wall. The wear surface arrangement for a coupler carrier assembly thus provides improved wear surfaces that are interchangeable for the carrier housing when using type F metallic coupler carriers.

U.S. Pat. No. 4,344,541 ('541 patent), which issued to Chierici, discloses a Coupler Carrier Arrangement for Railroad Cars. The '541 patent teaches a coupler carrier arrangement for railroad cars, in which the car center sill ends are equipped with a striker casting through which the car coupler shank extends for connection to the car center sill, with the striker casting having the familiar cage, in which the coupler carrier is mounted, including an upwardly opening socket on the underside of the casting defining a coupler carrier chamber, in which the coupler carrier itself comprises a body formed from an ultra high molecular weight polymer of self-lubricating characteristics that replaces both the conventional coupler carrier and the carrier iron, and is shaped to define a horizontally disposed upwardly facing load support surface on which the coupler shank rests, and oppositely facing forward and rearward side walls defining vertically disposed slide surfaces formed for close fitting relation to the coupler carrier chamber inner and outer walls. The coupler carrier load support and side slide surfaces are of integral one piece construction, and are characterized by effecting resurfacing of the coupler shank and striker casting surfaces they engage to make such surfaces effectively resistant against wear. The coupler carrier arrangement for railroad cars of the '541 patent thus uses a non-metallic type F coupler carrier, and teaches certain fundamental problems when using metallic coupler carriers and the advantages to using a fully non-metallic type F coupler carrier.

U.S. Pat. No. 4,445,618 ('618 patent), which issued to Kulieke, Jr., discloses a Spring Biased Rotary Railway Car Coupler Carrier. The '618 patent teaches a rotary railroad car coupler assembly having a unique carrier which is designed for limited angling or tilting in the vertically elongated chamber of the striker, as the coupler rotates. The projecting lugs of the carrier interlockingly engage the stops in the chamber of the striker, and have sloping sides which diverge from the sidewalls of the chamber in a direction away from the coupler, rather than being parallel to the sidewalls as are the sides of the lugs of AAR Standard carriers. This improvement eliminates chattering that is normally occasioned when AAR Standard carriers are used in connection with a rotary railroad car coupler assembly and helps to prevent undue stress of the striker caused when the carrier becomes momentarily frozen or bound up in the striker as the coupler rotates. The '618 patent further teaches certain fundamental problems when using type F metallic coupler carriers and further presents the desire and advantage of using a non-metallic type F coupler carrier.

U.S. Pat. No. 4,674,639 ('639 patent), which issued to Kaim, discloses a Railway Coupler Carrier Retention System. The '639 patent teaches a railway coupler carrier retention system using hardened metallic sloped carrier lugs with related retainer plates to provide longitudinal and lateral movement restraint. The '639 patent further teaches the scope of certain fundamental wear problems when using type F metallic coupler carriers and further presents the desire and advantage of using a non-metallic type F coupler carrier. The '639 patent further illustrates a form of the geometric relief between the lugs and the sidewalls of the metallic carrier but does not disclose this as improvement. This patent incorporates the use of a relief in a non-metallic coupler carrier and therefore is novel in combined nature.

U.S. Pat. No. 4,706,826 ('826 patent), which issued to Elliott et al., discloses a Striker Carrier having an Adjustable Wear Plate for a Railway Coupler(s). The '826 patent teaches a striker carrier assembly for a railway coupler constructed to engage and support the shank of the coupler at an adjustably established elevation. For an E-type coupler, the striker carrier assembly includes a spacer retained on the striker carrier by an overlying wear plate which includes downwardly extending lugs on opposite sides of the wear plate. For an F-type coupler, the striker carrier includes a striker casting supported by springs against a stop in a carrier basket. A spacer is held on top of the striker casting by a wear plate through the use of prongs which extend downwardly from the plate through openings in both the spacer and striker casting. The wear surface arrangement for a metallic coupler carrier provides an overlying metallic wear plate with improved wear surfaces that are interchangeable for the type F metallic coupler carrier. The '826 patent further teaches certain fundamental problems when using type F metallic coupler carriers.

The following publications provide certain useful information relating to non-metallic type F carrier lug construction: Mar. 21, 2001 Flyer Edition of Zeftuf® Flexible Coupler Carriers for "F" Type Draft Sills published by Zeftec Incorporated, Montgomery, Ill. and publication HOL970057-1M-498 Flyer Edition of Hollube® Product Specification for Model: WE-4004 Coupler Carrier for Rotary Dump Coal Cars published by Holland Company, Crete, Ill. both disclose marketing of non-metallic type F coupler carriers. It will be seen from an inspection of the noted publications that the same recite the fact that all prior art non-metallic type F coupler carriers exhibit relatively sharp edges adjacent to and on the carrier lugs along with a substantially planar bottom.

It will be seen that the forgoing prior art teaches certain parameters for type F coupler carriers and use various specific solutions to meet the needs taught. The instant invention departs from the prior art by utilizing the non-metallic material for improved wear resistance and improving the geometry of a non-metallic type F coupler carrier to enhance the limited functionality in its use for type F coupler carrier arrangements. The instant invention utilizes simple, yet offers a type F coupler carrier with advantages that will be obvious or become apparent from a consideration of the following descriptions.

SUMMARY OF THE INVENTION

Accordingly, this invention relates is an improved configuration of a non-metallic railroad type F coupler carrier having improved geometry enhancing both operational characteristics including increased loss prevention. A principal object of the present invention is to provide a type F coupler carrier for a type F coupler carrier arrangement of the sprung type which eliminates the striker casting cage side wall, retainer plate, and coupler shank wear problem without requiring modification of the striker casting, retainer plate, and coupler shank itself, or the introduction of wet lubricants or movement guides to protect the said parts surfacing involved.

Occasionally service conditions are of a severe nature where abrasive conditions are such that prior art non-metallic type F coupler carrier lug surfaces adjacent to the retainer plates wear significantly at the expense of providing wear protection to the retainer plates to maintain one of the principal objects of eliminating retainer plate wear. The result of this prior art non-metallic type F coupler carrier lug wear is that sharp edges are enhanced along with the creation of very small fillet features that create increased stress concentrations and results in increasing the notch sensitivity. Over time wear creates a thinner non-metallic type F coupler carrier lug in combination with a large stress concentration resulting in a geometry that is susceptible to crack initiation and then fatigue crack growth and ultimately fracture of the thinner non-metallic type F coupler carrier lug.

Another principal object of the invention is to provide a non-metallic type F coupler carrier with geometric improvements of edges with blended relief's and radii so as to provide reduced stress concentrations and eliminate the development of detrimental stress concentrations inherent to previous non-metallic coupler carrier art. Yet another major object of the invention is to provide a carrier body of one piece integral construction that fits into and operates within the striker casting cage, which body is of self-lubricating characteristics for eliminating striker casting cage wear as a maintenance problem for the railroads; at the same time, avoiding the need to have the familiar expendable coupler carrier iron.

Other important objects of the invention are to provide a type F coupler carrier for an arrangement that supports the coupler shank for easy manual shifting of the coupler laterally of the car, and to provide a coupler carrier that reduces friction of coupler horizontal and vertical movements to the extent that prime mover energy requirements for the train in which the car in question is incorporated are reduced. To aid with accomplishing the major objects of the invention, the non-metallic type F coupler carrier is to consist of self-lubricating, economical yet tough material, such as ultra high molecular weight polyethylene or other materials having improved durability through improved materials. While self-lubricating materials such as UHMWPE have certain advantages, and may even be preferred, other materials may be suitable. The geometry of this design may therefore permit the use of materials using other strength and durability properties advantageously.

Still other objects of the invention are to provide a type F coupler carrier that is economical of manufacture, that may be installed at least as readily as conventional type F coupler carriers, and that is long lived in use. In accordance with the invention, a one piece non-metallic type F coupler carrier body that is formed from an UHMW polymer of self-lubricating characteristics that is resiliently mounted in the striker casting cage and defines a horizontally disposed upwardly facing load support surface of special characteristics on which the coupler shank rests, and oppositely facing side walls defining vertically disposed slide surfaces of special characteristics that are formed for close fitting relation with the striker casting cage inner and outer side walls.

In some prior art type F coupler carrier arrangements, the striker casting is of a one-piece construction while other arrangements consist of 2 or more piece construction. For ease of discussion herein, this invention will refer to a one piece striker casting construction.

Other objects, uses and advantages will be obvious or become apparent from a consideration of the following detailed description and the application drawings in which like reference numerals indicate like parts throughout the several views.

BRIEF DESCRIPTION OF THE DRAWINGS

Other features of my invention will become more evident from a consideration of certain brief descriptions of patent drawings.

DETAILED DESCRIPTION OF THE PREFERRED EMBODIMENT(S)

Figure 1:
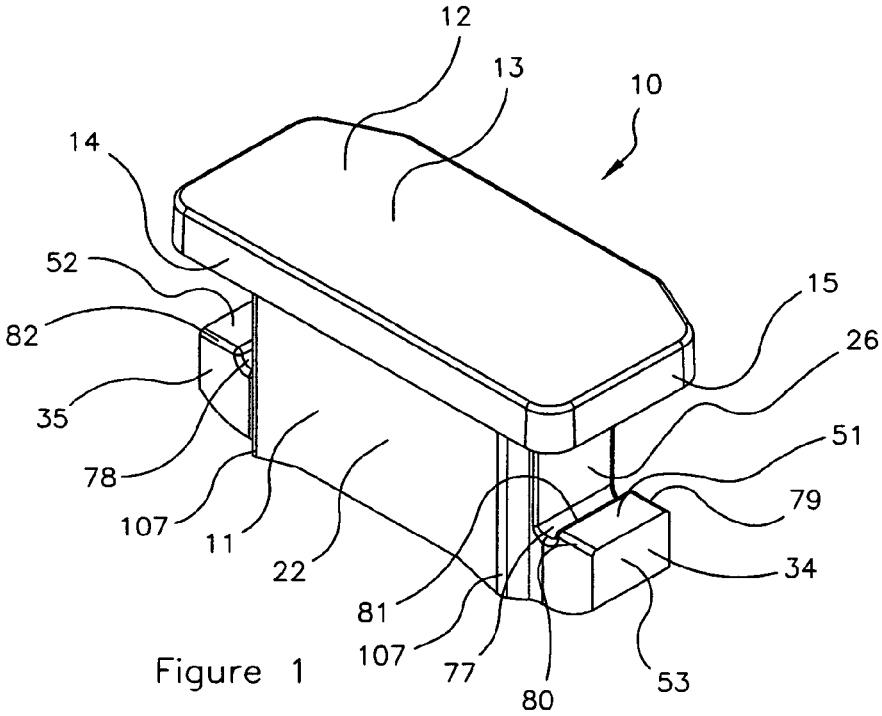
FIG. 1 is a largely schematic perspective frontal view of the non-metallic type F coupler carrier.
Figure 2:
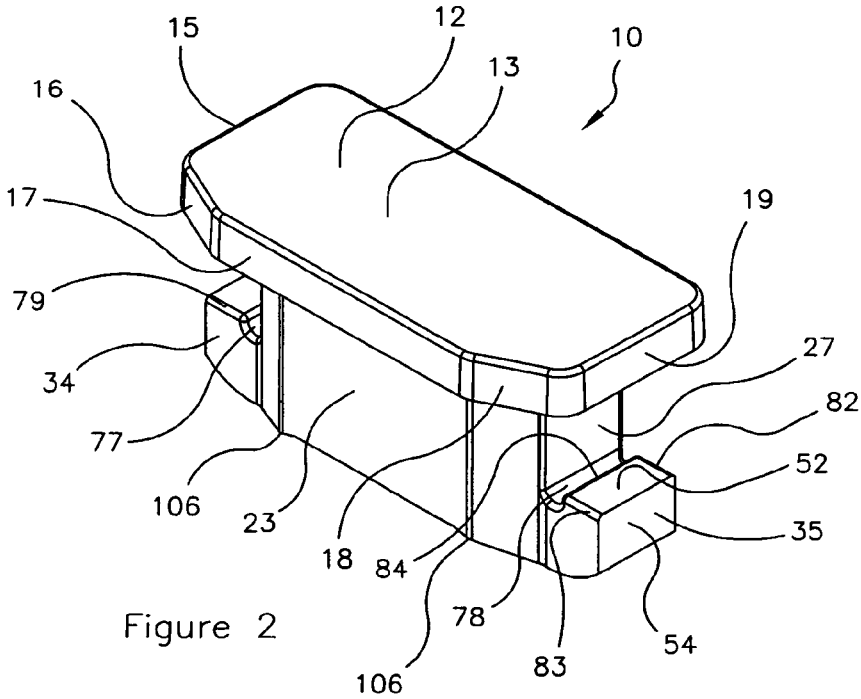
FIG. 2 is a largely schematic perspective back view of the non-metallic type F coupler carrier.
Figure 3:
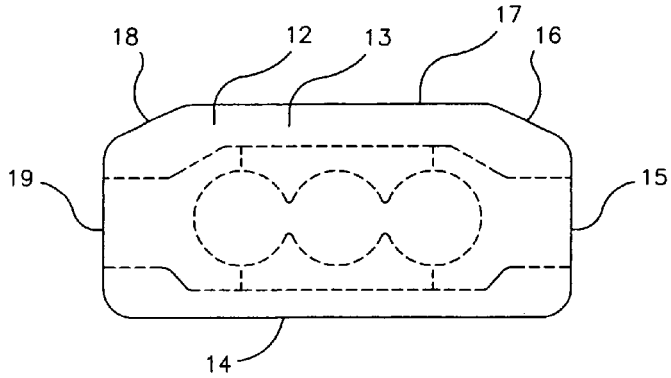
FIG. 3 is a top horizontal view of the non-metallic type F coupler carrier.

Referring now to FIGS. 1 and 2, there is illustrated in somewhat of frontal and back side diagrammatic views of coupler carrier 10 or coupler carrier construction formed of a non-metallic material preferably of an ultra high molecular weight polymeric material following the principles of the present invention hereinafter disclosed. FIGS. 1 through 6 further illustrates coupler carrier 10 comprising of a body 11 of molded one piece construction that includes an upper flanged platform portion 12 defining a substantially planar load support surface 13 on which the substantially planar surface 57 of coupler shank 30 is to rest. The platform portion 12 is flanged with sides 14, 15, 16, 17, 18, 19 about its margin and is proportioned and shaped to fit within the window or mouth 21 of the striker casting 20. The coupler carrier body 11 below its platform portion 12 is of oblong configuration defining forward wall 22 and rearward wall 23 that respectively oppose the cage surfaces 24, 25 when coupler carrier 10 is mounted in the operating position shown in FIGS. 7 and 8.

The coupler carrier body 11 defines side walls 26, 27 below platform portion 12 in a manner to aid in forming notched areas 28, 29. Coupler carrier body 11 is further defined by lugs 34, 35 protruding below and outward from side walls 26, 27 respectively completing the forming of notched areas 28, 29 for cooperation with the conventional retainer plates 31, 32 (or carrier stop structure) that are fixed to the striker casting 20 employing suitable fasteners 33, 43 as shown in FIG. 9.

Figure 5:
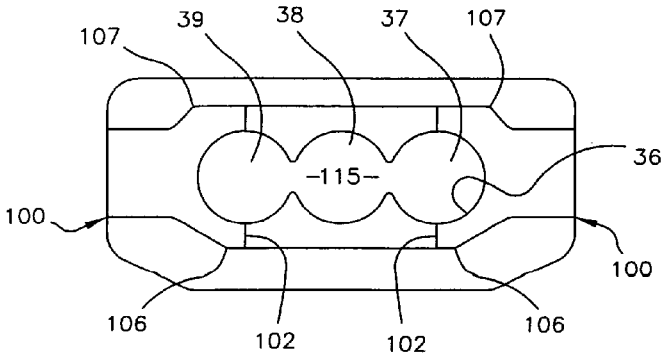
FIG. 5 is a bottom horizontal view of the non-metallic type F coupler carrier.

FIG. 5 illustrates that the bottom or bottom portion of coupler carrier body 11 is centrally formed to define a combined plurality of circular recesses 36 each terminating in spring seats 37, 38, 39 at the inner end of the same for receiving the respective load support springs 40, 41, 42 that interposed between the coupler carrier body 11 and the floor 44 of striker casting cage 45 of striker casting 20. Load support springs 40, 41, 42 each seat on a spring seat portions 46, 47, 48 of the floor 44 of striker casting cage 45 of striker casting 20 as illustrated in FIGS. 8 and 9. FIG. 9 is a partial frontal elevational view taken on line 98 of FIG. 7.

Figure 7:
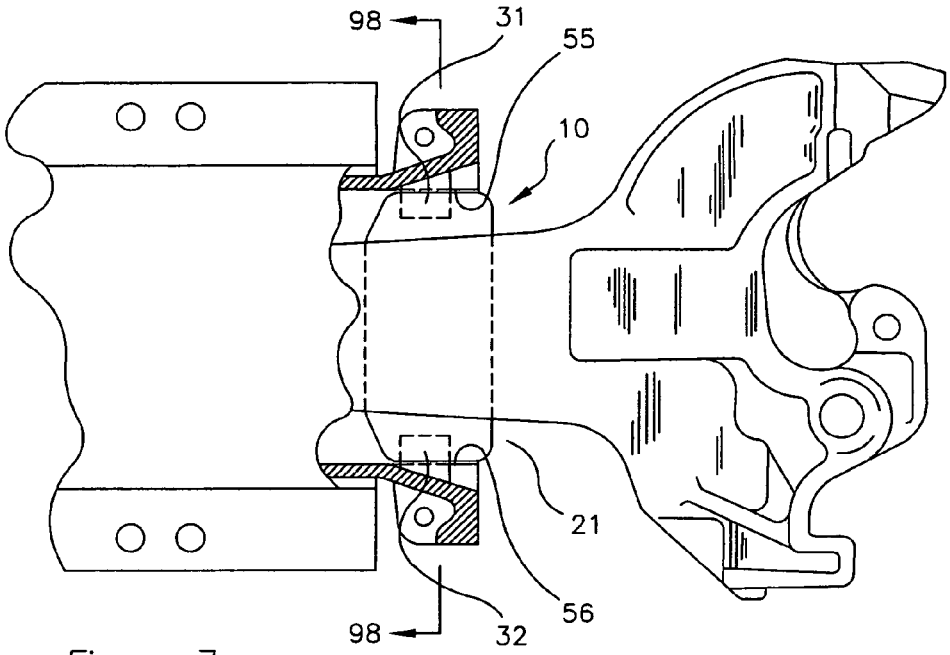
FIG. 7 is a top horizontal view of the end of a car center sill showing the coupler and striker casting as applied thereto, and partially broken away to show or indicate specific parts of the assembly involved.
Figure 8:
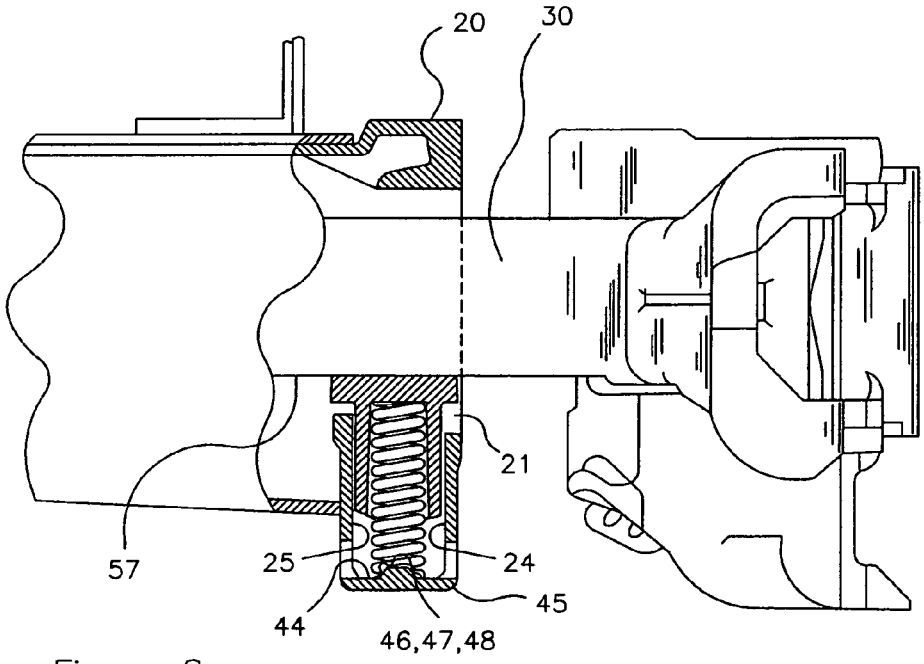
FIG. 8 is a side elevational view of the end of a car center sill showing the coupler and striker casting as applied thereto, and partially broken away to show or indicate specific parts of the assembly involved.
Figure 9:
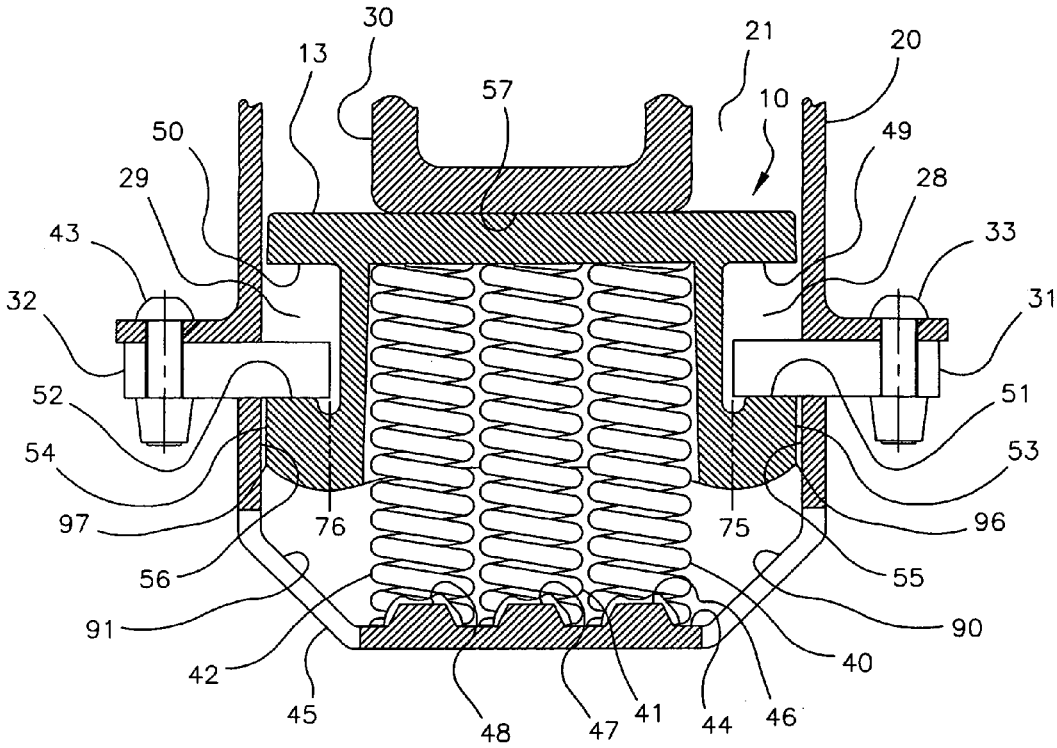
FIG. 9 is a front elevational view taken on line 98 in FIG. 7 partially broken away to show the striker casting, non-metallic type F coupler carrier and other specific parts of the assembly involved.

Notched areas 28, 29 are respectively shaped to define opposed lug stop surfaces 51, 52 at either lug 34, 35 of coupler carrier body 11 which serve to limit the range of upward vertical movement permitted by body 11 when mounted in its operating position shown in FIGS. 7, 8 and 9. The lugs 34, 35 of coupler carrier body 11 define substantially planar side lug walls 53, 54 respectively for cooperation with the substantially planar opposed cage surfaces 55, 56 of striker casting cage 45 of striker casting 20 as shown in FIG. 9.

In accordance with the invention, coupler carrier 10 is formed in a one piece configuration from ultra high molecular weight (UHMW) polyethylene preferably having a molecular weight in the range from about 3 million to about 10.5 million grams/mole. In the preferred embodiment, coupler carrier 10 is formed from molecularly oriented UHMW polyethylene marketed by Ticona LLC of Summit, N.J. under the trademark GUR PE-UHMW. The material specified is an UHMW polymer of self-lubricating characteristics that is sufficiently compaction resistant to resist any substantial compaction under compressive forces up to its elastic limit, and has a high degree of elastic memory for full return to original shape after being stressed, up to its elastic limit. This material also has a high degree of toughness and long wearing characteristics and is also receptive to (1) fillers in the form of glass, clay, sand, suitable fabrics, and alumina and (2) processing adjustments to affect cross-linking of the material for modifying same to adapt the coupler carrier 10 for specific conditions. Further advantages of this material are disclosed herein and previously taught in prior art.

Figure 11:
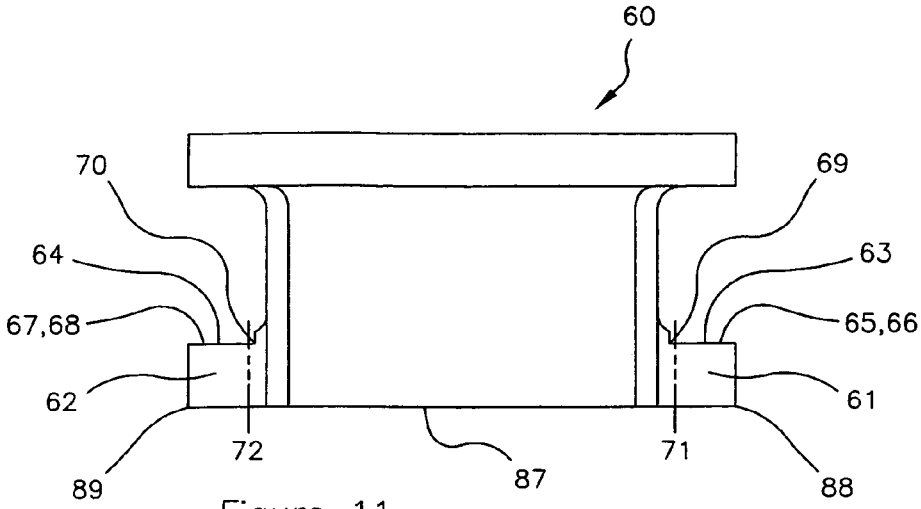
FIG. 11 is a front elevational view of the prior art non-metallic type F coupler carrier with worn lugs illustrating sharp fillet and increased stress concentration.
Figure 12:
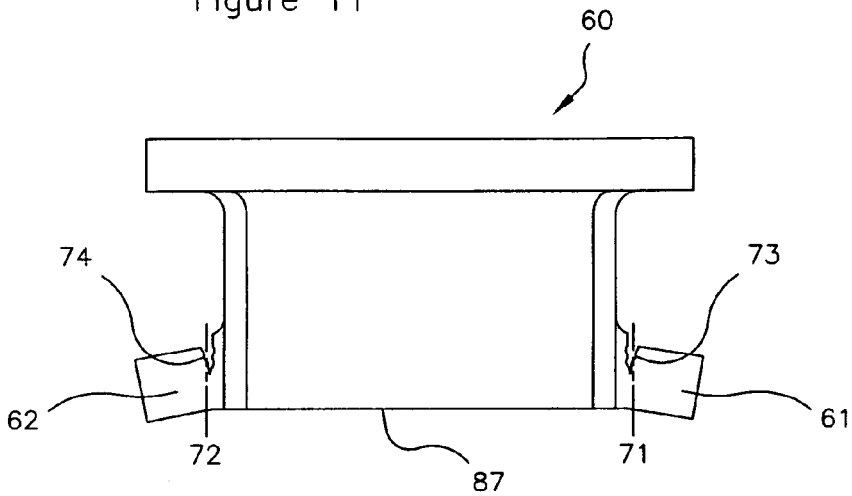
FIG. 12 is a front elevational view of the prior art non-metallic type F coupler carrier with worn lugs illustrating being bent and cracked do to the sharp fillet and increased stress concentration.

In accordance with the invention, the coupler carrier 10 is proportioned so its forward wall 22, rearward wall 23, and lug-bearing, laterally-opposed side walls or side lug walls 53, 54 of coupler carrier body 11 will be in closely spaced relation to the respective cage surfaces 24, 25, 55, 56 of striker casting cage 45 of striker casting 20 as shown in FIGS. 7, 8 and 9 for making the rubbing contact therewith that has been the source of wear problem in connection with conventional coupler carrier and carrier iron assemblies. It has been found that occasionally service conditions are of a severe oscillating or vibratory nature so abrasive conditions are such that prior art non-metallic type F coupler carrier 60 shown in FIG. 10 with lug stop surfaces 58, 59 of lugs 61, 62 adjacent to the retainer plates 31, 32 wear significantly at the expense of maintaining the principal object of the invention by providing wear protection to the retainer plates 31, 32. FIG. 11 illustrates, the result of this prior art lug stop surfaces 58, 59 being worn down over time and forming modified lug stop surfaces 63, 64 along with the development of laterally adjacent sharp edges 65, 66, 67, 68 along with the creation of very small fillets 69, 70 respectively. Small fillets 69, 70 result in the creation of increased stress concentrations and also results in increasing the notch sensitivity. Also, over time wear creates thinner lugs 61, 62 along lines 71, 72 and is illustrated in FIG. 11. Thinner lugs 61, 62 in combination with relatively large stress concentrations do to the small fillets 69, 70 result in a geometry that is susceptible to crack initiation and than fatigue cracks 73, 74 grow and ultimately the fracture of the thinner lugs 61, 62 as illustrated in FIG. 12.

In accordance with the invention, and another principal object of the invention is to provide a coupler carrier 10 with geometric improvements of rounded edges 79, 80, 81, 82, 83, 84 adjacent to lug stop surfaces 51, 52 of lugs 34, 35. These rounded edges 79, 80, 81, 82, 83, 84 are formed to provide blended edges so as to provide reduced stress concentrations and eliminate the development of detrimental stress concentrations compared to previous art. Also, in accordance with the invention, and another principal object of the invention is to provide a coupler carrier 10 with geometric improvements of substantially concave filleted relief's 77, 78 or concave relief portions adjacent to lug stop surfaces 51, 52 of lugs 34, 35 and adjacent to side walls 26, 27 of coupler carrier body 11 and are illustrated along lines 75, 76 in FIGS. 4, 9 and 13. These substantially concave relief's 77, 78 or concave relief portions are formed so as to provide reduced stress concentrations and eliminate the development of detrimental stress concentrations compared to previous art that is disclosed herein and will be apparent to those skilled in the art.

The significance of the forming of stress concentrations is well understood and proven by the fact of specially developed and published impact testing by the Association of Standard Test Methods also know as the ASTM Standards. Reference to ASTM standard D-4020 will teach that the preferred material used in this invention is extremely impact and crack resistant and so much so that the material can not be cracked using specimens manufactured per previous test standards such as ASTM D-256 with pre-existing notches with radii as small as 0.010 inches (or 0.25 mm). Therefore ASTM D-4020 was developed to provide methods to be able to consistently fracture UHMW-PE by way of teaching the fabrication of the type of higher degree stress concentrations required to fracture the preferred material. It is the intent of this invention to incorporate relief's 77, 78 adjacent to lug stop surfaces 51, 52 of lugs 34, 35 of coupler carrier 10 of such a form to eliminate the formation of stress concentrations that are detrimental as previously disclosed and shown in FIGS. 11 and 12.

Figure 13:
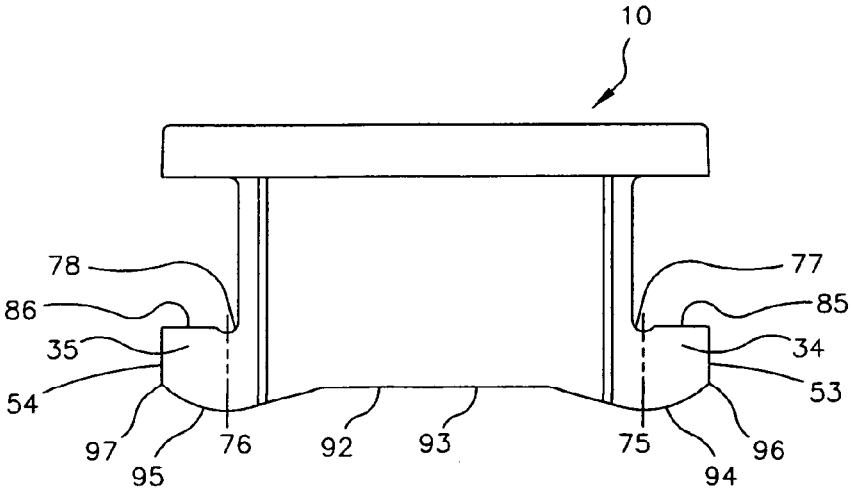
FIG. 13 is a front elevational view of the improved non-metallic type F coupler carrier with worn lugs illustrating that there is no creation of a sharp fillet or increased stress concentration.

FIG. 13 illustrates lug stop surfaces 51, 52 having been worn to form lug stop surfaces 85, 86 comparable to worn lug stop surfaces 63, 64 of prior art coupler carrier 60 shown in FIG. 11, without the formation of small fillets resulting in the creation of increased stress concentrations as previously disclosed. Also, in accordance with the invention, and another principal object of the invention is to provide a coupler carrier 10 with geometric improvements to eliminate the creation of thinner lugs 34, 35 of coupler carrier 10.

Figure 10:
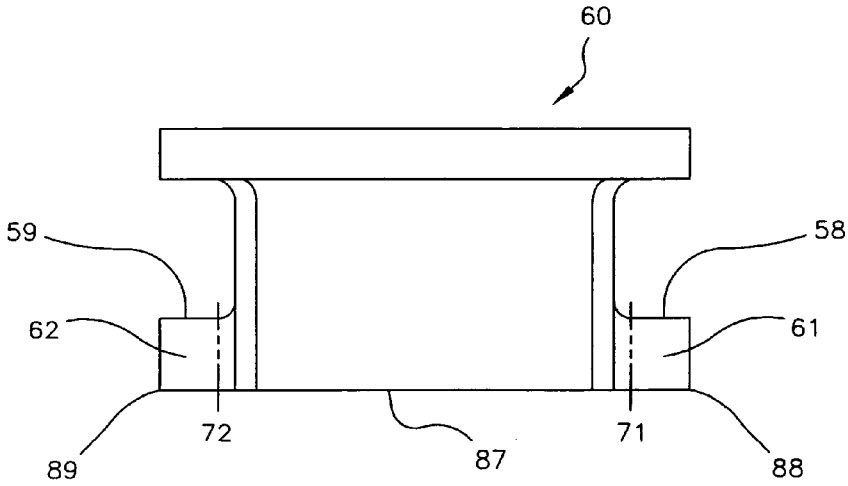
FIG. 10 is a front elevational view of the prior art non-metallic type F coupler carrier.

As previously disclosed, prior art coupler carrier 60 as shown in FIG. 10 illustrates a particular unworn thickness of lugs 61, 62 along lines 71, 72. All prior art non-metallic type F coupler carriers typically used in industry have exhibited an unworn thickness along lines 71, 72 no greater than 1.68 inches do to the nature of the substantially planar bottom surface 87 of prior art coupler carrier 60. The reason for this thickness is to prevent the outside edges 88, 89 of substantially planar bottom surface 87 of prior art coupler carrier 60 from hitting the inside sloped surfaces 90, 91 of striker casting cage 45 when load support springs 40, 41, 42 are compressed by coupler shank 30 in such a manner to cause such action. This invention improves upon this marginal wall thickness by providing a coupler carrier 10 with unworn top-to-bottom lug thicknesses along lines 75, 76 shown in FIGS. 4, 9, and 13 greater than the 1.68 inches of previous art by providing a novel coupler carrier bottom 90 that is not substantially planar for lugs 34, 35.

Figure 4:
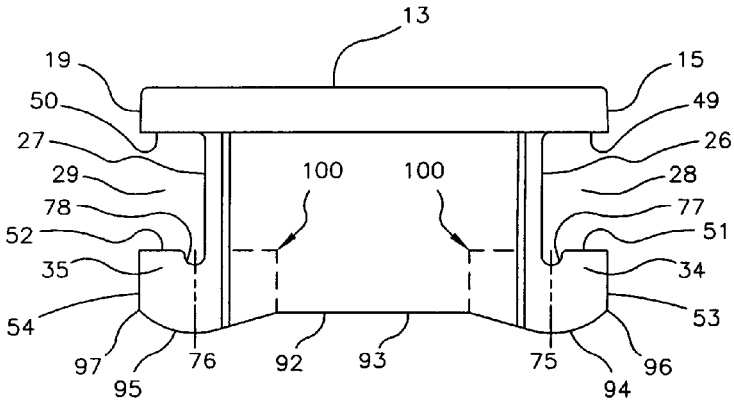
FIG. 4 is a front elevational view of the non-metallic type F coupler carrier.
Figure 6:
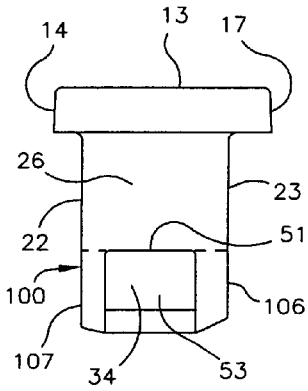
FIG. 6 is a side elevational view of the non-metallic type F coupler carrier.

Referring to FIGS. 4, 9, 13, it will be seen that that the coupler carrier bottom 90 of coupler carrier 10 consists of two substantially convex surfaces 94, 95 on the bottom side of lugs 34, 35 to provide the thicker section along lines 75, 76 and enhance the desired improvement as previously disclosed. The central area of coupler carrier bottom 92 is illustrated as a substantially planar bottom surface 93 recessed from the convex surfaces 94, 95 and is desired for use as a reference surface for easier verification checking during installation of type F coupler carrier arrangements. Substantially planar bottom surface 92 is illustrated as recessed but is not required to be recessed for proper function and its relative location may be adjusted as so desired as long as it does not detract from proper function as disclosed herein.

Substantially convex surfaces 94, 95 on the bottom side of lugs 34, 35 are blended and sloped to form edges 96, 97 that is adjacent to substantially planar side lug walls 53, 54 respectively. The location of edges 96, 97 and slope of convex surfaces 94, 95 are defined so as not to hit the inside sloped surfaces 90, 91 of striker casting cage 45 when load support springs 40, 41, 42 are compressed by coupler shank 30 in such a manner to cause such action. The thickness of lugs 34, 35 of coupler carrier 10 is allowed to be tailored along lines 75, 76 and the thicknesses adjacent to such reference as allowed by the object of the novel invention and those skilled in the art.

Figure 17:
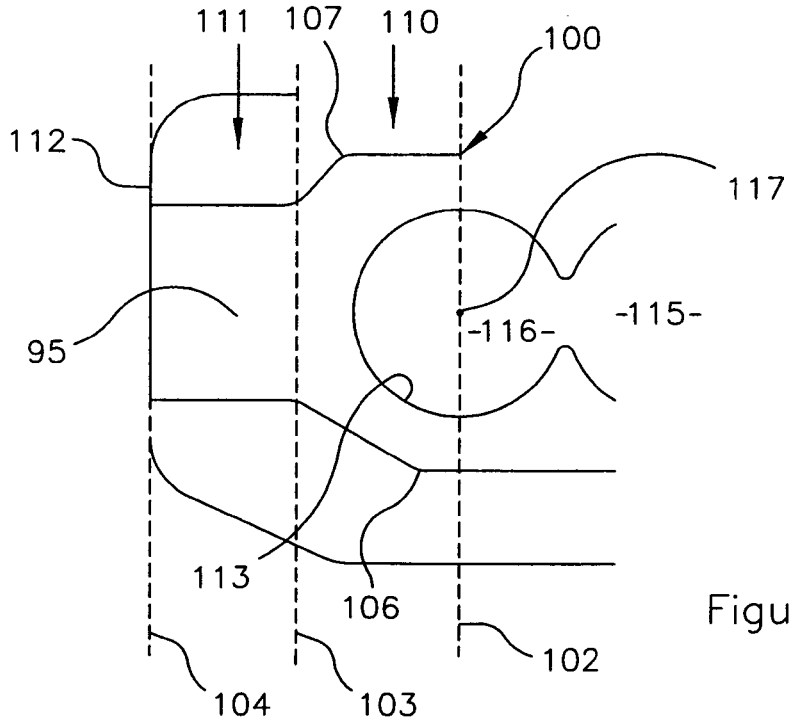
FIG. 17 is an enlarged fragmentary bottom horizontal view of the left lug region of the non-metallic type F coupler carrier otherwise depicted in FIG. 15.

The present invention thus provides a type F coupler carrier preferably constructed from self-lubricating, cross-linked, ultra high molecular weight polyethylene material which may be further reinforced with fillers. The coupler carrier according to the present invention may be said to essentially comprise an upper portion as at 12; a bottom portion as perhaps best viewed in FIGS. 5, 15, and 17; a forward wall as at 22, a rearward wall as at 23, and opposed side walls as at 26 and 27.

The bottom portion comprises opposed, three-dimensional lug regions 100 as specifically depicted and referenced in FIGS. 14-17. From an inspection of the noted figures, it will be seen that lug regions 100 are formed at the bottom portion adjacent the side walls 26 and 27. In this regard, it will be noted that the lug regions 100 may be spatially defined by the structural volume (a) inferior or beneath a first frontal plane as at 101, which plane 101 is parallel to the upper portion 12; and (b) lateral to inner transverse planes as at 102, which planes 102 are parallel to the respective side walls 26 and 27.

Figure 14:
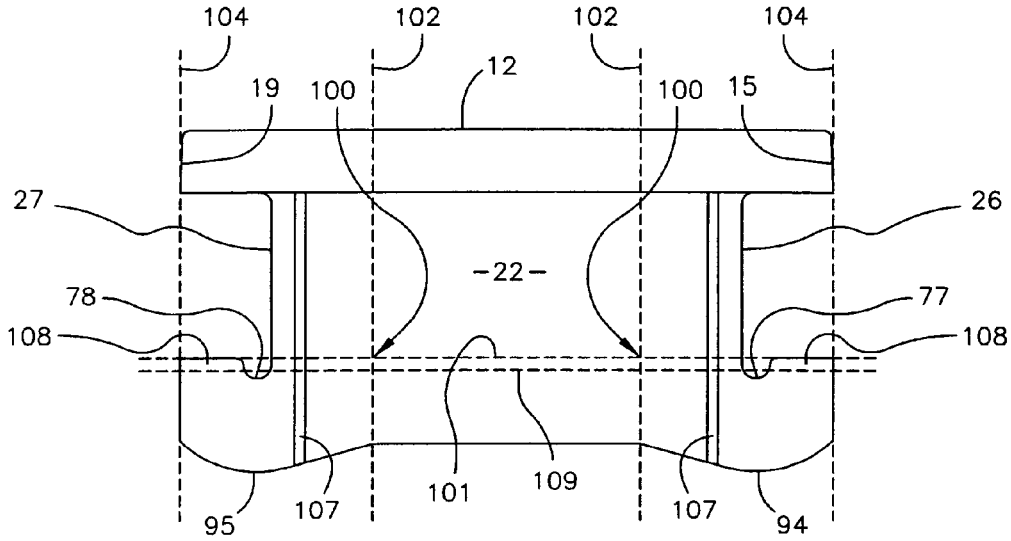
FIG. 14 is an enlarged front elevational view of the non-metallic type F coupler carrier otherwise depicted in FIG. 4.
Figure 15:
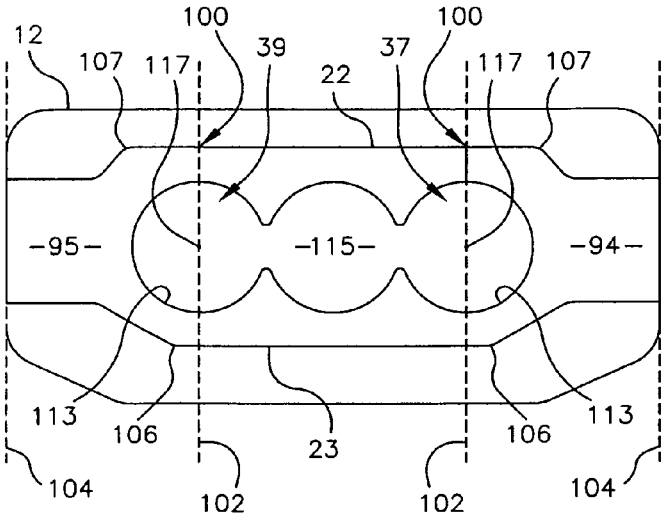
FIG. 15 is an enlarged bottom horizontal view of the non-metallic type F coupler carrier otherwise depicted in FIG. 5.
Figure 16:
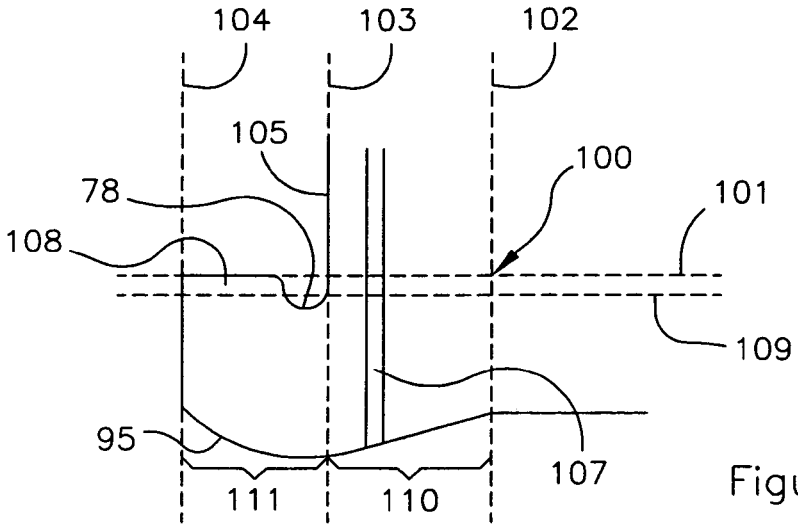
FIG. 16 is an enlarged fragmentary front elevational view of the lower left lug region of the non-metallic type F coupler carrier otherwise depicted in FIG. 14.

From a comparative inspection of FIG. 14 versus FIG. 16, it will be seen that the lug regions 100 are each substantially U-shaped in a first dimension, which dimension is orthogonal the frontal plane 101 and the inner transverse planes 102. From a comparative inspection of FIG. 15 versus 17, it will be further seen that the lug regions 100 are each substantially Y-shaped in a second dimension parallel to the first frontal plane 101.

The lug regions 100 each further comprise wall-based portions as at 110 and lug portions 111. The wall-based portions 110 are respectively defined or bound by opposed mid-transverse planes 103 parallel to the inner transverse planes 102 coplanar with side walls 26 and 27 or side wall surfacing as at 105. The lug portions 111 are respectively defined or bound by outer transverse planes 104 parallel to the inner transverse planes 102 and mid-transverse planes 103. In this regard, the reader should note that the upper portion 12 comprises longitudinally opposed termini as at 15 and 19. Preferably, the longitudinally opposed termini 15 and 19 are coplanar with the outer transverse planes 104.

It should be further noted that the wall-based portions 110 are preferably C-shaped in said second dimension such that the C-shaped wall-based portions 110 comprise concave inner surfacing as at 113. The surfacing 113 may be said to define or bound lateral boundaries of an inner spring-receiving aperture as at 115, which inner spring-receiving aperture 115 extends parallel to the mid-transverse planes 103.

More particularly, in this last regard, the concave inner surfacing 113 preferably bounds a cylindrically-segmented, multi-coil-receiving aperture 115. The multi-coil-receiving aperture 115 preferably comprises laterally opposed cylindrical segments or recesses as at 39 and 37, which laterally opposed cylindrical segments or recesses 39 and 37 respectively have parallel centric axes as at 117. Preferably, the centric axes 117 are coplanar with the inner transverse planes 102.

The lug regions 100 further comprise convex surfacing as at 94 and 95 and concave surfacing as at 77 and 78. The convex surfacing 94 and 95 is located in the first dimension intermediate the inner transverse planes 102 and the outer transverse planes 104 opposite the frontal plane 101, and the concave surfacing 77 and 78 is located in the first dimension intermediate the mid-transverse planes 103 and outer transverse planes 104 opposite the frontal plane 101. The lug regions 100 each further preferably comprise certain convex or angled surfacing as at 106 and 107 in the second dimension intermediate the inner transverse planes 102 and the mid-transverse planes 103.

The lug portions 111 thus form arch-extended laterally-opposed lugs as at 34 and 35, which lugs 34 and 35 each arch-extend outwardly and respectively from the side walls 26 and 27. Each lug 34 and 35 preferably comprises a wear zone as at 108, which wear zone 108 may be further defined as being bound by a second frontal plane 109 parallel to the first frontal plane 101 opposite the upper portion 12. The wear zones 108 are wearable over the course of the effective coupler carrier life such that the material thickness of the lug portions 111 and lug regions 100 adjacent the wear zones 108 remains constant during lug wear. It is contemplated that the described double-arched lug construction and the sacrificial wear zones 108 effectively function to resisting stress fractures therewithin.

While the above descriptions contain much specificity, this specificity should not be construed as limitations on the scope of the invention, but rather as an exemplification of the invention. For example, the invention may be said to essentially teach or disclose a type F coupler carrier or coupler carrier construction configured for cooperative load-supporting, wear resistance intermediate a coupler shank and a striker cage assembly. In this regard, it will be recalled that the striker cage may comprise transversely rectangular movement-restricting structure and certain carrier stop structure. In other words, the striker cage may comprise outer, inner, and laterally-opposed upright walls and certain retainer plates. The coupler carrier construction of the present invention may be said to essentially comprise an upper load-supporting, platform portion, a bottom portion, forward, rearward, and laterally-opposed side walls, and laterally-opposed lugs. The lugs extend outwardly from the laterally-opposed side walls and having outwardly facing lug slide surfaces and upwardly facing lug slide surfaces. The platform portion essentially functions to support the coupler shank of a coupler assembly.

The forward and rearward side walls extend downwardly from the platform portion and thereby form wall slide surfaces, the wall slide surfaces are designed to oppose the outer and inner upright walls of the striker cage; the outwardly facing lug slide surfaces are designed to oppose the laterally-opposed upright walls of the striker cage; and the upwardly facing lug slide surfaces are designed to oppose the carrier stop structure or retainer plates of the coupler assembly. The bottom portion is preferably sized and shaped to cooperatively accommodate striker casting cages of varying configurations.

The lugs may preferably comprise concave relief portions intermediate the upwardly facing lug slide surfaces and the laterally-opposed side walls. It is contemplated that the concave relief portions may well function to enhance resistance to stress concentration development in that region. Further, the lugs may preferably comprise a top-to-bottom lug thickness greater than 1.68 inches for the reasons set forth hereinabove.

In essence, the present invention may be said to provide a coupler carrier comprising an upper portion, a bottom portion, forward, rearward, and opposed side walls, wherein the bottom portion comprises opposed, three-dimensional lug regions having double-arched lug constructions. The lug constructions each have a first arch (one of which is depicted in FIG. 15) extending in a first dimension and a second arch (one of which is generally depicted in FIG. 16) extending in a second dimension orthogonal to the first dimension.

The first arch has a lug portion and a wall portion, which wall portion defines said second arch. The lug portions each preferably comprise a wear zone, which wear zones each arch-extend from the respective side walls and are parallel to the upper portion. The wear zones are wearable over the effective life of the coupler carrier such that the material thickness of the double-arched lug constructions adjacent the wear zones remain constant during lug wear. It is thus contemplated that the double-arched lug constructions effectively function to resist stress fractures therewithin.

Accordingly, although the invention has been described by reference to a preferred embodiment and certain alternatives thereof, it is not intended that the novel carrier construction be limited thereby, but that modifications thereof are intended to be included as falling within the broad scope and spirit of the foregoing disclosure, the following claims and the appended drawings.

I claim:

1. A type F coupler carrier, the F coupler carrier being constructed from polyethylene material and comprising an upper portion, a bottom portion, and forward, rearward, and opposed side walls, the bottom portion comprising opposed, three-dimensional lug regions adjacent the side walls, the lug regions being spatially defined by structural volume (I) inferior to a first frontal plane parallel to the upper portion, and (II) lateral to inner transverse planes parallel to the respective side walls, the lug regions each being substantially (A) U-shaped in a first dimension orthogonal the frontal and inner transverse planes, and (B) Y-shaped in a second dimension parallel to the first frontal plane, the lug regions each comprising (1) wall-based portions further respectively defined by opposed mid-transverse planes parallel to the inner transverse planes coplanar with side wall surfacing, (2) lug portions further respectively defined by outer transverse planes parallel to the inner and mid-transverse planes, (3) convex surfacing in the first dimension intermediate the inner and outer transverse planes opposite the frontal plane, (4) concave surfacing in the first dimension intermediate the mid- and outer transverse planes opposite the frontal plane, and (5) convex surfacing in the second dimension intermediate the inner and mid-transverse planes, the lug portions thus forming laterally-opposed lugs, the lugs each arch-extending outwardly from the side walls and comprising a wear zone, the wear zone being further defined by a second frontal plane parallel to the first frontal plane opposite the upper portion, the wear zones being wearable such that the material thickness of the lug regions adjacent the wear zones remains constant during lug wear, the three-dimensional lug regions for resisting stress fractures therewithin.

2. The coupler carrier of claim 1 wherein the wall-based portions are C-shaped in said second dimension, the C-shaped wall-based portions in said second dimension comprising concave inner surfacing, said concave inner surfacing defining lateral boundaries of an inner spring-receiving aperture, the inner spring-receiving aperture extending parallel to the mid-transverse planes.

3. The coupler carrier of claim 2 wherein the concave inner surfacing bounds a cylindrically-segmented, multi-coil-receiving aperture.

4. The coupler carrier of claim 3 wherein the multi-coil-receiving aperture comprises laterally opposed cylindrical segments, the laterally opposed cylindrical segments respectively having parallel centric axes, the centric axes being coplanar with the inner transverse planes.

5. The coupler carrier of claim 4 wherein the upper portion comprises longitudinally opposed termini, the longitudinally opposed termini being coplanar with the outer transverse planes.

6. A type F coupler carrier, the type F coupler carrier comprising an upper portion, a bottom portion, and forward, rearward, and opposed side walls, the bottom portion comprising opposed, three-dimensional lug regions adjacent the side walls, the lug regions being spatially defined by structural volume (I) inferior to a first frontal plane parallel to the upper portion, and (II) lateral to inner transverse planes parallel to the respective side walls, the lug regions each being substantially (A) U-shaped in a first dimension orthogonal the frontal and inner transverse planes, and (B) Y-shaped in a second dimension parallel to the frontal plane thereby providing opposed double arch lug constructions, each double-arched lug construction having a first arch in said first dimension and a second arch in said second dimension, the first arch having a first lug portion and a first wall portion, the first wall portions defining the second arches, the first lug portion further comprising a wear zone, the wear zones each being arch-extended from the respective side walls and parallel to the upper portion, the wear zones being wearable such that the material thickness of the lug regions adjacent the wear zones remains constant during lug wear, the double-arched lug constructions for resisting stress fractures therewithin.

7. The coupler carrier of claim 6 wherein the first wall portions are C-shaped in said second dimension, the C-shaped wall-based portions in said second dimension comprising concave inner surfacing, said concave inner surfacing defining lateral boundaries of an inner spring-receiving aperture, the inner spring-receiving aperture extending parallel to the mid-transverse planes.

8. The coupler carrier of claim 7 wherein the concave inner surfacing bounds a cylindrically-segmented, multi-coil-receiving aperture.

9. The coupler carrier of claim 8 wherein the multi-coil-receiving aperture comprises laterally opposed cylindrical segments, the laterally opposed cylindrical segments respectively having parallel centric axes, the first wall portions being bound by inner transverse planes, the centric axes being coplanar with the inner transverse planes.

10. The coupler carrier of claim 6 being formed from a polyethylene material.

11. The coupler carrier of claim 10 wherein the polyethylene material is self-lubricating.

12. The coupler carrier of claim 10 wherein said polyethylene is cross linked.

13. The coupler carrier of claim 10 wherein the polyethylene material comprises an ultra high molecular weight.

14. The coupler carrier of claim 10 wherein the polyethylene material is reinforced with fillers.

15. A coupler carrier, the coupler carrier comprising an upper portion, a bottom portion, and forward, rearward, and opposed side walls, the bottom portion comprising opposed, double-arched lug constructions, the double-arched lug constructions each comprising (1) a first arch in a first dimension, (2) a second arch in a second dimension orthogonal to the first dimension, and (3) wear zone, the first arches each having a lug portion and a wall portion, the wall portions defining the second arches, the wear zones each being arch-extended from the respective side walls and parallel to the upper portion, the wear zones being wearable such that the material thickness of the double-arched lug constructions adjacent the wear zones remain constant during lug wear, the double-arched lug constructions for resisting stress fractures therewithin.

16. The coupler carrier of claim 15 being formed from a polyethylene material.

17. The coupler carrier of claim 16 wherein the polyethylene material is self-lubricating.

18. The coupler carrier of claim 16 wherein said polyethylene is cross linked.

19. The coupler carrier of claim 16 wherein the polyethylene material comprises an ultra high molecular weight.

20. The coupler carrier of claim 16 wherein the polyethylene material is reinforced with fillers.

21. The coupler carrier of claim 15 wherein the wall portions are C-shaped in said second dimension, the C-shaped wall portions in said second dimension comprising concave inner surfacing, said concave inner surfacing defining lateral boundaries of an inner spring-receiving aperture.

22. The coupler carrier of claim 21 wherein the concave inner surfacing bounds a cylindrically-segmented, multi-coil-receiving aperture.

* * * * *